US009052656B2

(12) United States Patent
Shibaki

(10) Patent No.: US 9,052,656 B2
(45) Date of Patent: Jun. 9, 2015

(54) CLEANING DEVICE AND FIXING DEVICE

(71) Applicant: CANON KABUSHIKI KAISHA, Tokyo (JP)

(72) Inventor: Seiji Shibaki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/018,564

(22) Filed: Sep. 5, 2013

(65) Prior Publication Data

US 2014/0064801 A1 Mar. 6, 2014

(30) Foreign Application Priority Data

Sep. 6, 2012 (JP) ..... 2012-195674

(51) Int. Cl.
*G03G 15/20* (2006.01)

(52) U.S. Cl.
CPC ..... *G03G 15/2075* (2013.01); *G03G 15/2025* (2013.01)

(58) Field of Classification Search
CPC ..... G03G 15/2075; G03G 15/2025
USPC ..... 399/327, 345, 352
See application file for complete search history.

(56) References Cited

U.S. PATENT DOCUMENTS

| | | | | |
|---|---|---|---|---|
| 5,970,281 | A * | 10/1999 | Park | 399/101 |
| 6,459,865 | B2 * | 10/2002 | Kusayanagi | 399/101 |
| 7,630,675 | B2 | 12/2009 | Tateishi et al. | |
| 2008/0138103 | A1 * | 6/2008 | Nakano | 399/71 |
| 2012/0003020 | A1 * | 1/2012 | Furuya et al. | 399/327 |
| 2013/0045031 | A1 * | 2/2013 | Nagata et al. | 399/327 |
| 2014/0064754 | A1 * | 3/2014 | Hara | 399/43 |

FOREIGN PATENT DOCUMENTS

JP 2008-015444 A 1/2008

* cited by examiner

*Primary Examiner* — Rodney Bonnette
(74) *Attorney, Agent, or Firm* — Fitzpatrick, Cella, Harper & Scinto

(57) ABSTRACT

A cleaning device includes a cleaning unit which includes a web; a first roller, a second roller for winding the web up, a driving mechanism for second roller, a third roller urging the web to the rotatable member, an urging portion urging the third roller toward the rotatable member, and a supporter supporting the third roller while permitting movement relative to the first and second rollers; a moving mechanism for relative movement between the cleaning unit and the rotatable member, between a first position in which the web is spaced from the rotatable member and a second position in which they contact; and a controller. When the mechanism causes the relative movement from the first position to the second position, the controller operates the mechanism for a predetermined duration to substantially eliminate the slackness of the web resulting from the relative movement.

16 Claims, 9 Drawing Sheets

CLEANING DEVICE AND FIXING DEVICE

FIELD OF THE INVENTION AND RELATED ART

The present invention relates to a cleaning device for cleaning a rotatable member and to a fixing device provided with it.

In an image forming apparatus of an electrophotographic type, a fixing device is provided to fix a toner image formed on the recording material (sheet) by heating and pressing.

In such a fixing device, a cleaning device has been proposed in which a fixing roller (rotatable member) is cleaned by a web (Japanese Laid-open Patent Application 2008-15444).

More specifically, the web wound around a feeding roller is wound up on a winding-up roller via a press-contact roller disposed opposite of the fixing roller. The web is gradually wound up on the winding-up roller every predetermined number of the recording materials passing through a nip.

However, an improved cleaning device is desired.

SUMMARY OF THE INVENTION

According to an aspect of the present invention, there is provided a cleaning device comprising (i) a cleaning unit for cleaning a rotatable member, said cleaning unit including, (i-i) a web; (i-ii) a first roller on which said web is wound, (i-iii) a second roller configured and positioned to wind said web up, (i-iv) a driving mechanism configured to drive said second roller, (i-v) a third roller configured and positioned to urge said web to said rotatable member, (i-vi) an urging portion configured and positioned to urge said third roller toward said rotatable member, and (i-vii) a supporting mechanism supporting said third roller, said supporting mechanism permitting movement said third roller relative to said first roller and said second roller against an urging force of said urging portion; (ii) a moving mechanism configured and positioned to cause a relative movement between said cleaning unit and said rotatable member, between a first position in which said web is spaced from said rotatable member and a second position in which said web contacts said rotatable member; and (iii) a controller configured to control an operation of said driving mechanism, wherein when said moving mechanism causes the relative movement from the first position to the second position, said controller operates said driving mechanism for a predetermined duration to substantially eliminate the slackness of said web resulting from the relative movement.

These and other objects, features and advantages of the present invention will become more apparent upon a consideration of the following description of the preferred embodiments of the present invention taken in conjunction with the accompanying drawings.

DESCRIPTION OF THE EMBODIMENTS

Referring to the accompanying drawings, an image forming apparatus (fixing device) provided with a cleaning device according to the present invention will be described.

First Embodiment

General Structures of Image Forming Apparatus

Figure 1:
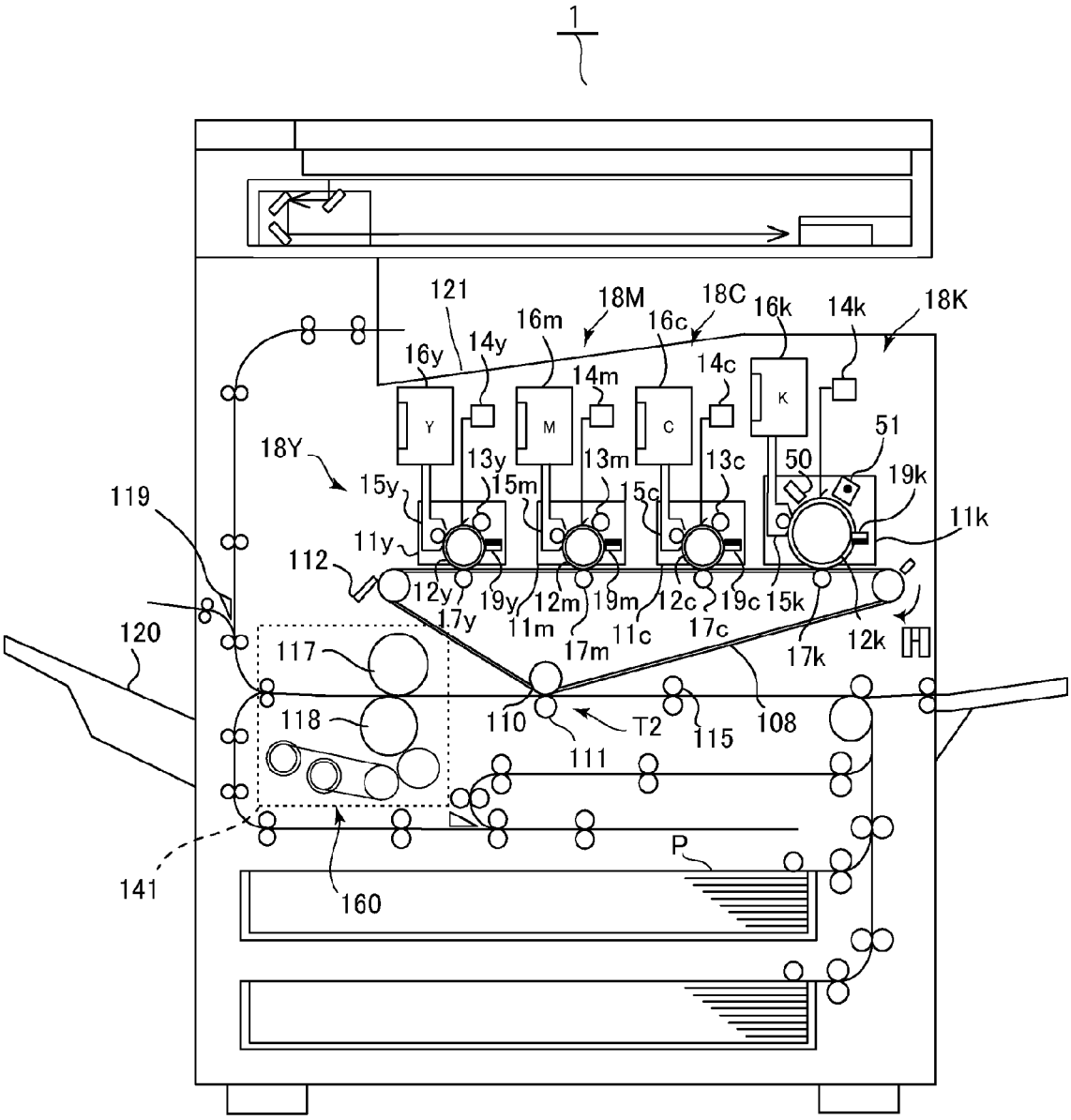
FIG. 1 is a schematic view of an image forming apparatus.

As shown in FIG. 1, an image forming apparatus 1 is a tandem full color printer of an intermediary transfer type including yellow, magenta, cyan and black image forming stations 18Y, 18M, 18C, 18K arranged along an intermediary transfer belt 108. Around a photosensitive drum 12*y* of the yellow image forming station 18Y, there are provided a charging roller 13*y*, an exposure device 14*y*, developing device 15*y*, a primary transfer roller 17*y* and an auxiliary charging brush 19*y*.

The photosensitive drum 12*y* is accommodated in a central portion of a process unit 11*y* and is rotated by a drum motor (unshown). The charging roller 13*y* uniformly charges the surface of the photosensitive drum 12*y*.

The exposure device 14*y* includes a laser scanner unit scanning the uniformly charged photosensitive drum 12*y* in a longitudinal direction with a laser modulated and outputted by a laser diode, using a polygonal mirror rotatable member, so that an electrostatic latent image is formed in accordance with input image information. The developing device 15*y* uses a two component developer comprising toner and carrier particles to develop the electrostatic latent image into the visualized toner image on the photosensitive drum. The developing device 15*y* is supplied with the toner from a toner bottle 16*y* filled with the toner.

The primary transfer roller 17*y* urges the endless intermediary transfer belt 108 to the photosensitive drum 12*y* to form a primary transfer portion between the intermediary transfer belt 108 and the photosensitive drum 12*y*, and is supplied with a DC voltage to transfer the toner image from the photosensitive drum 12*y* to the intermediary transfer belt 108. The auxiliary charging brush 19*y* electrically charges untransferred toner not transferred by the primary transfer roller 17*y* to provide such toner with uniform electric charge.

The above-described structures of the image forming station 18Y are substantially the same with the magenta, cyan and black image forming stations 18M, 18C, 18K. However, only the black image forming station 18K is different in that a potential sensor 50 for measuring a surface potential of the photosensitive drum 12*k* is provided. In addition, the black image forming station 18K is provided with a particular charging device 51 which is different from the charging roller 13*y* of the yellow image forming station 18Y, and the charging high voltage for the charging device 51 is adjusted on the basis of a detected value of the potential sensor 50.

Onto the intermediary transfer belt 108, yellow, magenta, cyan and black toner images are transferred by the image forming stations 18Y, 18M, 18C and 18K. The four color toner images carried on the intermediary transfer belt 108 are secondary-transferred all together onto the recording material (sheet) P by a secondary transfer portion T2. More specifically, the secondary transfer portion T2 includes a secondary transfer roller 110 on which the intermediary transfer belt 108 is winded and a secondary transfer opposing roller 111, in which the secondary transfer opposing roller 111 and the intermediary transfer belt 108 are contacted to each other to form a transfer nip. By the application of the DC voltage to the secondary transfer roller 110, the toner image is secondary-transferred from the intermediary transfer belt 108 onto the recording material P fed to the secondary transfer portion T2 from the registration roller 115. The remaining toner on the intermediary transfer belt not secondary-transferred to the recording material P in the secondary transfer portion T2 is collected by an intermediary transfer belt cleaner 112.

The recording material P carrying the four color toner images is separated by curvature from the intermediary transfer belt 108 and is fed into a fixing device 141 as an image heating apparatus. The fixing device 141 heats and presses the recording material P carrying the toner image to fix the unfixed toner image on the surface of the recording material P. The recording material P carrying the fixed toner image is discharged to a sheet discharge tray 120 or an inner sheet discharge tray 121.

<Structures of Fixing Device>

Referring to FIG. 2 through FIG. 5, the structures of said fixing device 141 will be described. As shown in part (a) of FIG. 2, the fixing device 141 includes an image heating portion 150 for heating the toner image formed on the recording material P, and a cleaning portion (cleaning device) 160 which will be described hereinafter in detail. The image heating portion 150 includes a heater 151, a fixing roller (heating member) 117 which is a rotatable member heated by the heater 151, a pressing roller (pressing member) 118 which is a rotatable member and a temperature uniforming roller 126 which is a rotatable member. The pressing roller 118 is movable toward and away from the fixing roller 117 by a pressing roller moving mechanism 153, and forms a nip 152 for heating and feeding the recording material P in contact with the fixing roller 117. The temperature uniforming roller 126 is a follower roller which comprises metal having a high thermal conductivity and which is movable toward and away from the pressing roller 118 by a temperature uniformizing roller moving mechanism (moving mechanism) 154 (FIG. 3), the follower roller being rotated by the pressing roller.

Figure 3:
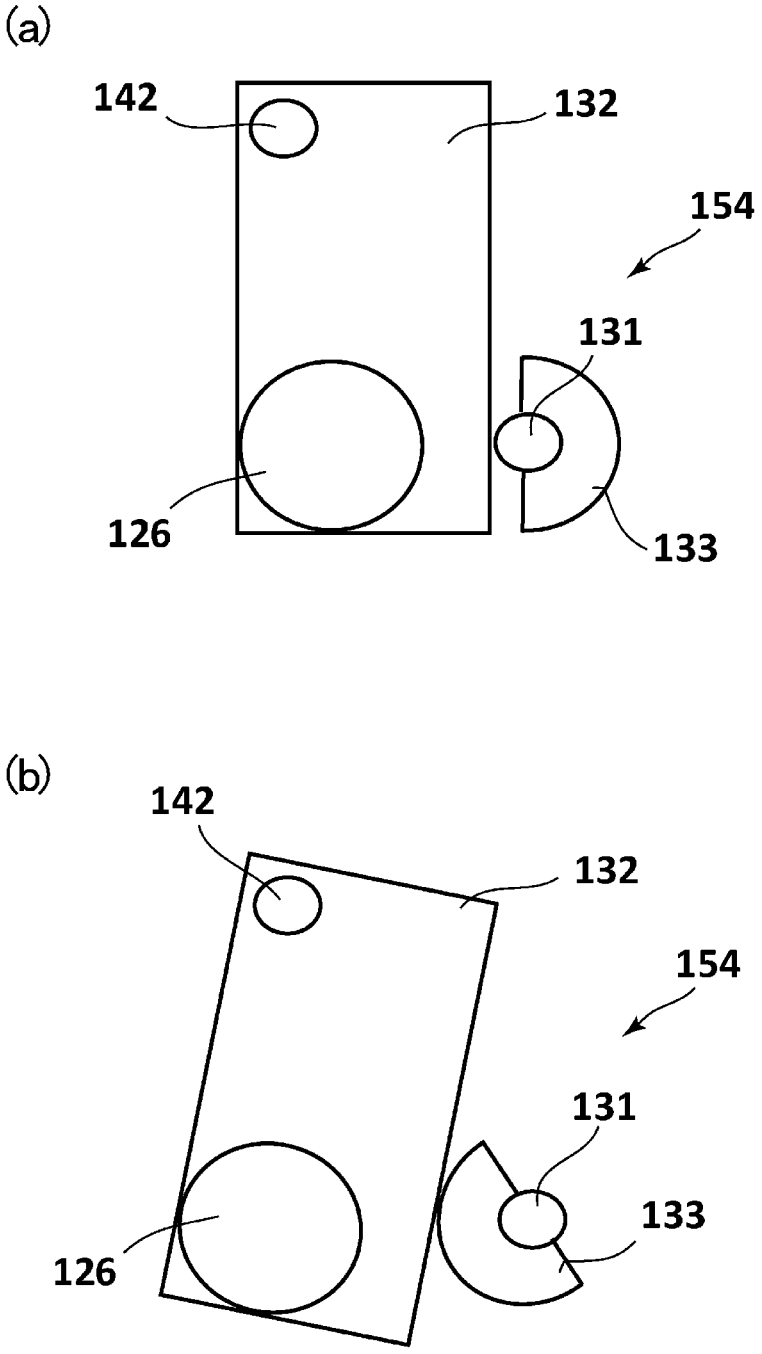
FIG. 3 is a schematic view of a temperature uniformizing roller moving mechanism, in which (a) shows a spacing position, and (b) shows a contact position.

As shown in FIG. 3, the temperature uniformizing roller moving mechanism 154 comprises a temperature uniformizing roller unit 132 rotatably supporting the temperature uniforming roller 126, and cam mechanisms 131, 133 urging the temperature uniformizing roller unit 132. More specifically, the temperature uniformizing roller unit 132 is rotatably together with the temperature uniformizing roller unit 132 about a unit rotation shaft 142. The cam mechanism comprises a rotatable cam shaft 131 and a cam 133 mounted to the cam shaft 131.

By the cam 133 abutting the temperature uniformizing roller unit 132, the temperature uniformizing roller unit 132 moves about the unit rotation shaft 142 from a position shown in part (a) of FIG. 3 to a position shown in part (b) of FIG. 3. By this, the temperature uniforming roller 126 is movable from a spacing position (part (b) of FIG. 2) in which it does not contact the pressing roller 118 to a contact position (part (a)/(c) of FIG. 2) in which it contacts the pressing roller 118.

The contact position and the spacing position of the temperature uniforming roller 126 is selected on the basis of a number of continuous prints after a print start and/or a detected temperature by a thermister provided on the fixing roller 117. More specifically, in this embodiment, the temperature uniforming roller 126 is moved from the spacing position to the contact position when the number of the continuous prints reaches 25, or when the temperature detected by the thermister exceeds 225 degrees Celcius. When the temperature uniforming roller 126 contacts the pressing roller 118, the distribution of the surface temperature of the pressing roller 118 becomes uniform so that an end portion temperature rise of the pressing roller 118 can be suppressed.

The movement from the contact position to the spacing position is carried out when a deduced heat quantity of the pressing roller 118 becomes lower than a predetermined value. More specifically, a deduced accumulation heat quantity is determined from the number of the fixed prints and the time elapsed from the completion of the printing. In this embodiment, the deducing calculation is based on the assumption that 10 W is accumulated per print, and after the printing, 50 W escapes per second. In the job of 30 sheet prints, 3000 W is accumulated, and 50 W is lost per sec, and when the predetermined value is 0 W, the temperature uniforming roller is spaced at 60 (3000/50=60) second after the print completion.

The continuous number of the continuous prints, the thermister temperature and the heat quantity estimation are determined properly by a person of ordinary skill in the art depending on the power of fixing device 141 or the like. Results of experiments and measurements on the used fixing device, values acquired by theoretical value calculation, a width of the recording material, the material of the recording material and/or a meter temperature measurement degrees value detected by a thermister provided exclusively for the control may be taken into account. In order to acquire a current angle of the cam 133 correctly, a sensor for detecting the position of the cam 133 may be additionally used.

<Cleaning Portion>

Figure 4:
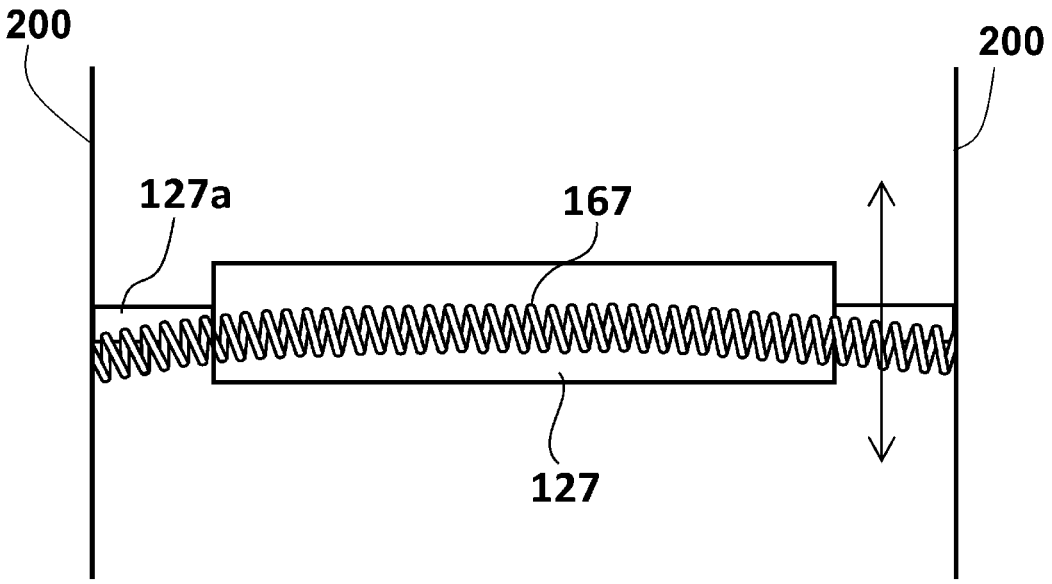
FIG. 4 is a schematic view illustrating an urging structure for a movement roller.

Structures of the cleaning portion (cleaning device) 160 of the fixing device 2 will be described. The cleaning portion 160 (cleaning unit) removes deposited matter (toner and paper dust or the like) deposited to the rotatable member of the image heating portion 150 (image heating apparatus). More specifically, as shown in part (a) of FIG. 2, the cleaning unit includes a web (cleaning web 128), a supply roller 130, a movement roller 127, a winding-up roller 129, a spring 167 and a supporting mechanism 200 (FIG. 4).

The cleaning web 128 is a web member in the form of a sheet of non-woven paper (nonwoven fabric), is wound beforehand on the supply roller 130 as a supply member, and is wound up on the winding-up roller 129 as a winding-up member. The cleaning web 128 is urged to the temperature uniforming roller 126 by a movement roller 127 at a position between the supply roller 130 and the winding-up roller 129. In addition to the supply roller 130 and the winding-up roller 129, the cleaning portion 160 includes a moving mechanism 154, 127 for changing the relative position between the cleaning web 128 and the temperature uniforming roller 126.

Figure 2:
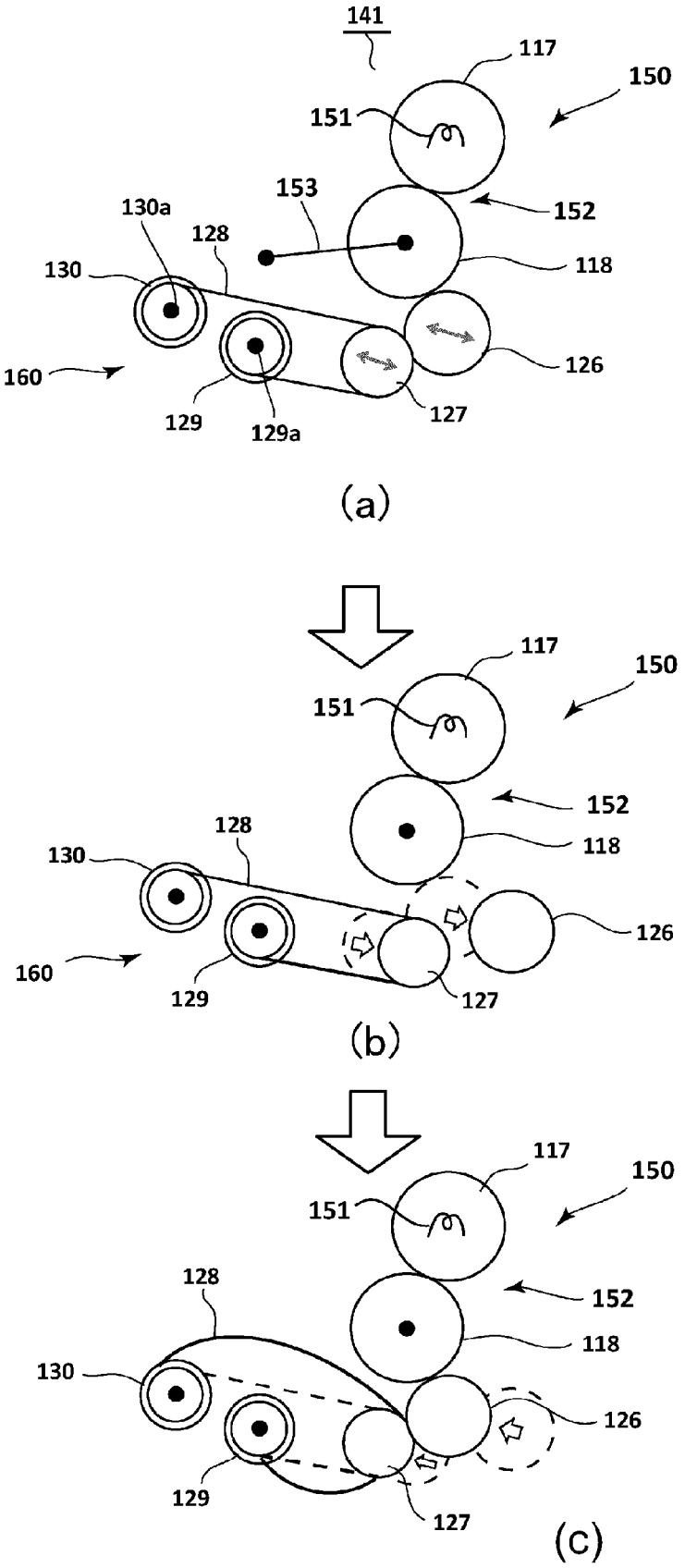
FIG. 2 is a schematic view of a fixing device, in which (a) shows a state that a temperature uniforming roller is in a contact state, (b) shows a spaced state, and (c) shows a state after the temperature uniforming roller changes from the spaced state to the contact state.

The moving mechanism 154, 127 changes the relative position between and web 128 and the temperature uniforming roller 126 between a contact state (part (a) of FIG. 2) and a spaced state (part (b) of FIG. 2) between the cleaning web 128 and the temperature uniforming roller 126. More specifically, the moving mechanism includes a temperature uniformizing roller moving mechanism 154 for moving the temperature uniforming roller 126 to and away from the pressing roller 118, and a movement roller 127 (urging member) for urging the cleaning web 128 toward the temperature uniforming roller 126. Around the movement roller 127, the cleaning web 128 is wound at a position between the supply roller 130 and the winding-up roller 129. A rotation shaft 127*a* of the movement roller 127 is supported swingably in the direction indicated by the arrow by the supporting mechanism 200 shown in FIG. 4. On the other hand, rotation shafts 129*a*, 130*a* of the rollers 129, 130 are supported immovably in the cleaning unit. As shown in FIG. 4, the movement roller 127 is hooked by a spring (urging portion) 167 to be urged toward the temperature uniforming roller 126 by an urging force of the spring 167.

Therefore, as shown in part (c) of FIG. 2, the cleaning web 128, when the temperature uniforming roller 126 is brought into contact to the pressing roller 118 (contact position) by the temperature uniformizing roller moving mechanism 154, the cleaning web 128 is press-contacted to the temperature uniforming roller 126 with movement roller 127. In the contact position, the cleaning web 128 is press-contacted to the temperature uniforming roller 126 by a predetermined urging force of the spring 167 (contact state). As shown in FIG. 2, a direction in which the temperature uniforming roller 126 urges the pressing roller 118 using the temperature uniformizing roller moving mechanism 154 is different from the direction in which the movement roller 127 urges the web 128 toward the temperature uniforming roller 126. Therefore, the contact pressure between the web 128 and the temperature uniforming roller 126 are to be at a proper level.

In this example, no large scale structure such as that for urging an entire cleaning unit toward the temperature uniforming roller 126 by a spring or the like is employed, but only the movement roller 127 is selectively urged by the spring. Therefore, the force for urging the web 128 to the temperature uniforming roller 126 can be assured with high accuracy by the urging force of the spring urging the movement roller 127. In other words, the contact pressure between the web 128 and the temperature uniforming roller 126 can be assured using a simple and easy structure. In this manner, the movement roller 127 can make a relative movement toward and away from the supply roller 130 and the winding-up roller 129.

Figure 5:
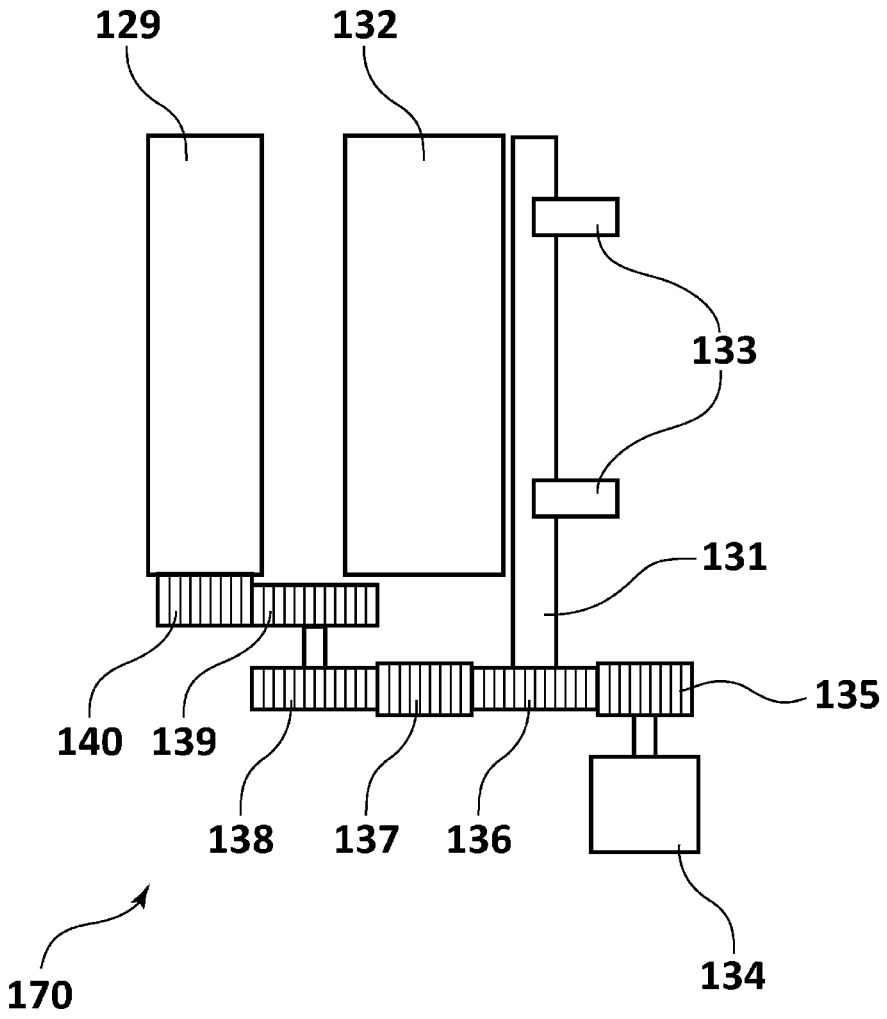
FIG. 5 is a schematic view of a temperature uniformizing roller moving mechanism and a winding-up roller.

As shown in FIG. 5, a driving source for the winding-up roller 129 and that for the temperature uniformizing roller moving mechanism 154 are common. More specifically, the winding-up roller 129 is rotated by power from a web motor (driving source) 134 is a driving mechanism through a power transmission mechanism 170 as a driving mechanism to wind up the cleaning web 128 wound to the supply roller 130.

The power transmission mechanism 170 is provided with two one-way clutch gears 136 and 138 (gears having respective one-way clutches), wherein idling direction of the one-way clutch gears 136 and 138 are different from each other. When the web motor 134 rotates in the forward direction (second direction), a driving gear 135 provided on the rotation shaft of the web motor 134 rotates to rotate the first one-way clutch gear 136 engaged with the driving gear 135. The first one-way clutch gear 136 engages with the cam shaft 131 only in the forward rotation to transmit the rotational force so that the power is transmitted to the temperature uniformizing roller moving mechanism 154 through the cam shaft 131. Simultaneously, the rotational force is transmitted also to the second one-way clutch gear 138 through the intermediary gear 137, but the second one-way clutch gear 138 rotates idly (it is engaged with the shaft only in the reverse rotation), so that no driving force is transmitted to the winding-up roller 129.

On the other hand, when the web motor 134 rotates in the backward direction (first direction), the first one-way clutch gear 136 rotates idly, so that no power is transmitted to the temperature uniformizing roller moving mechanism 154. On the other hand, the second one-way clutch gear 138 transmits the power to the shaft when the web motor 134 rotates in the backward direction, and therefore, the winding-up roller 129 is rotated through the gears 139, 140.

In this manner, the power transmission mechanism 170 selectively transmits the rotational force of web motor 134 in the backward direction to the roller 129, and the rotational force of the web motor 134 in the forward direction to the temperature uniformizing roller moving mechanism 154 (moving mechanism).

In this embodiment, the power transmission mechanism 170 comprises a plurality of one-way clutches, but this is not inevitable, and ordinary clutches may be used, and the number and the idling directions of the one-way clutch may be properly selectable by a person of ordinary skill in the art.

<Controller>

Figure 6:
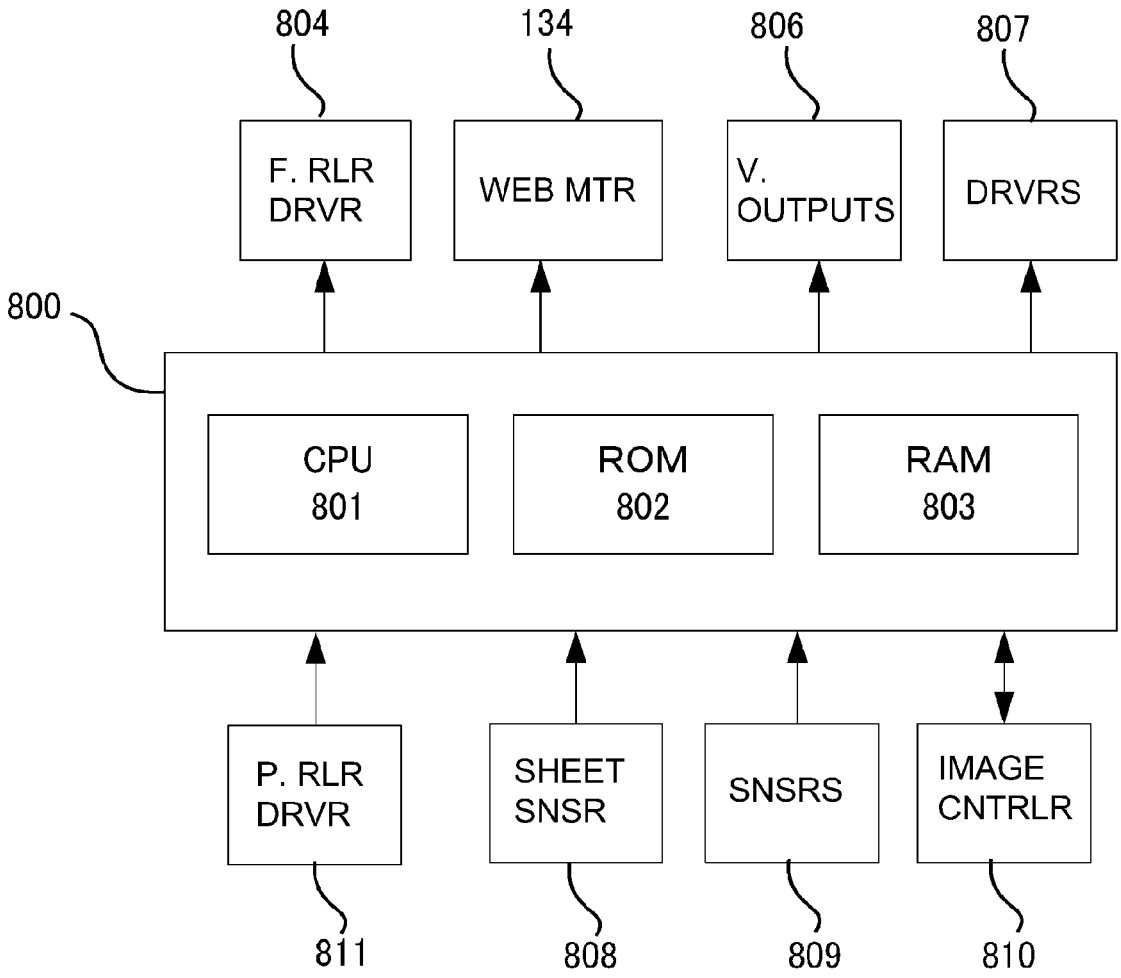
FIG. 6 is a block diagram of a controller.

Referring to FIG. 6, the controller for the image forming apparatus will be described. As shown in FIG. 6, a controller 800 of the image forming apparatus 1 comprises a computer including a calculation device 801 and storing devices 802, 803 and connecting with the image forming station 18 and the fixing device 141 or the like.

More specifically, to the calculation device (CPU) 801, they are connected through ROM 802 and RAM 803. ROM 802 stores various programs and data including a fixing control program for controlling the image heating portion 150 of the fixing device 141 and a cleaning program for controlling the cleaning portion 160. The RAM 803 includes a workspace for the calculation device 801.

To the calculation device 801, an image controller 810 and a voltage output portion 806 for the control of the image forming station 18 are connected. The image controller 810 carries out the control for the laser exposure to the image data, and the image reading control from a document reader and/or network. The voltage output portion 806 outputs voltages for the charging, the exposure, the development and the transfer.

In addition, to the calculation device 801, a fixing roller driver 804, a pressing roller driver 811, the web motor 134, and a fixing sheet discharge sensor 808, for the control of the fixing device 141, are connected. The fixing roller driver 804 rotates the fixing roller 117. The pressing roller driver 811 controls the pressing roller moving mechanism 153 to move the pressing roller 118 toward and away from the fixing roller 117. The calculation device 801 controls the web motor 134 so as to control the movement of the temperature uniforming roller 126 and the winding-up of the cleaning web. In addition, the fixing sheet discharge sensor 808 detects the recording material P passing through the fixing device 141 to transmit the event to the calculation device 801.

To the calculation device 801, various drivers 807 for actuating the motors, the solenoids and the clutch, and various sensors 809 for transmitting outputs of a flag sensor and a transmitting type sensor and input and output of an AD converter are connected.

<Cleaning Operation of Temperature Uniforming Roller>

The cleaning operation for the temperature uniforming roller using the cleaning program will be described. For the cleaning of the temperature uniforming roller 126 by the cleaning portion 160 (S100 of FIG. 7), the controller 800 discriminates whether or not the temperature uniforming roller 126 is currently in contact with the pressing roller 118 (S101).

If the temperature uniforming roller 126 is in the contact position namely it is in contact with the pressing roller 118 (S101), the controller 800 discriminates whether to switch the temperature uniforming roller 126 from the contact position to the spacing position. If controller 800 discriminates that the contact state is to be maintained (No of S102), it controls the cleaning portion 160 to execute the normal cleaning process (S130). That is, when the temperature uniforming roller 126 continues contacting the pressing roller 118 for more than a predetermined period (No of S102), the web 128 is discriminated as being in contact with the temperature uniforming roller 126. If a slack eliminate process for the web 128, which will be described hereinafter, has been carried out, it controls the cleaning portion 160 to execute the normal cleaning process (S130).

Figure 8:
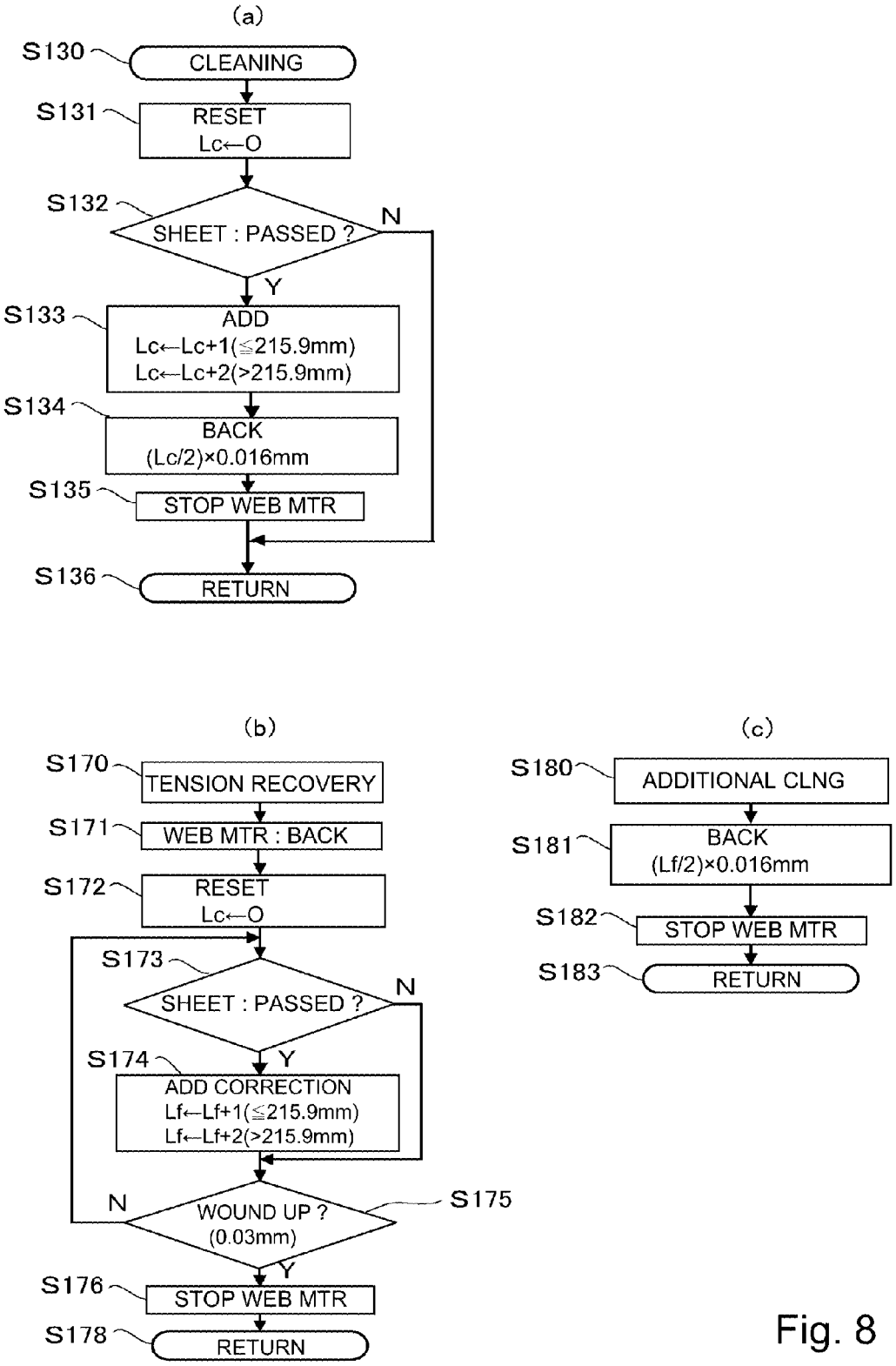
FIG. 8 is an sub-flowchart in which (a) is a flow chart showing a cleaning process, (b) is a flow chart showing a tension refreshing process, and (c) is a flow chart showing a correction cleaning process.

Specifically, as shown in part (a) of FIG. 8, for the start of the normal cleaning process (S130), the controller 800 first initializes a distance value Lc which is a value determining the winding-up amount of the cleaning web 128 (S131). Then, the controller 800 discriminates whether or not the recording material (sheet) P has passed through the fixing device 141, more particularly, the nip 152 (S132), and if so, a distance value is incremented (S133).

The amount of increment is dependent on the sheet size, and in this embodiment, the increment is "1" when the sheet size is not more than 215.9 mm, and the increment is "2", when the sheet size is larger than 215.9 mm.

When the distance value Lc is incremented, the controller 800 sets the winding-up amount Lt of the cleaning web 128 to $Lt=(Lc/2)\times 0.016$ (mm) to rotate the web motor 134 through the amount corresponding to the winding-up amount Lt (S134). The backward rotation of the web motor 134 is transmitted to the winding-up roller 129 through the gears 135, 136, 137, 138, 139, and 140 (FIG. 5), so that the cleaning web 128 is wound up. When the cleaning web 128 is wound up through the winding-up amount, the controller 800 stops the rotation of the web motor 134 (S135) to complete the cleaning process.

The passing of the recording material P of the fixing device 141 is detected by the fixing sheet discharge sensor 808 for detecting the recording material P at the exit portion of the nip 152. The size (length) of the recording material having passed through the fixing device 141 is determined referring to the sheet size selected in the print job in this embodiment, but it may be detected using a sensor on the basis of the time at which the fixing sheet discharge sensor 808 is actuated.

Figure 7:
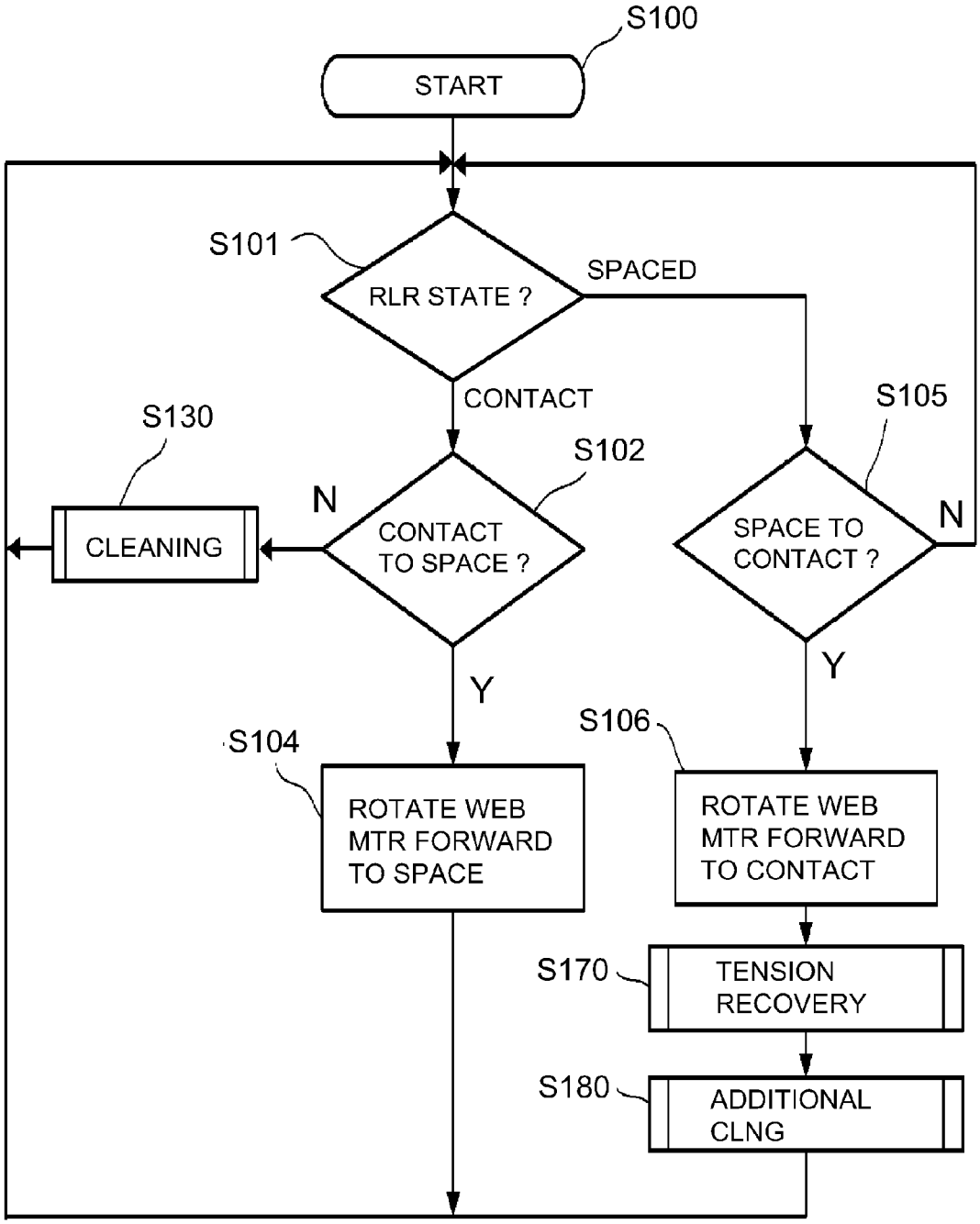
FIG. 7 is a main flow chart of a cleaning operation of a cleaning portion.

When the above-described cleaning process is completed, the controller 800 discriminates the state of the temperature uniforming roller again as shown in FIG. 7 (S10), and thereafter, it discriminates whether or not it is necessary to space the temperature uniforming roller 126 from the pressing roller 118.

When the heat quantity of pressing roller 118 is not more than a predetermined value, the controller 800 discriminates that the temperature uniforming roller 126 is to be switched from the contact position to the spacing position (Y of S102) to rotate the web motor 134 in the forward direction (S104). When the web motor 134 rotates in the forward direction, the rotational force is transmitted to the cam shaft 131 through the first one-way clutch gear 136 to disengage between the temperature uniformizing roller unit 132 and the cam 133 (FIGS. 3 and 5). By this, the temperature uniforming roller 126 is moved to the spacing position.

When the temperature uniforming roller 126 is moved to the spacing position, the controller 800 discriminates that the temperature uniforming roller 126 is spaced from the pressing roller 118 (spaced in S101) at the time of discrimination (S101). When the controller 800 discriminates that the temperature uniforming roller 126 is in the spacing position, the controller 800 discriminates whether to move the temperature uniforming roller 126 to the contact position (S105), and if it is not necessary to contact the temperature uniforming roller 126 to the pressing roller 118, the spaced state is maintained (N in S105). At this time, the temperature uniforming roller 126 is spaced from the pressing roller 118, and therefore, the web 128 is also spaced from the temperature uniforming roller 126. Since the movement roller 127 is movably supported by the supporting mechanism 200, the movement roller 127 is projected in the righthand direction as shown in part (b) of FIG. 2 by the spring 167.

On the other hand, if the controller 800 discriminates that the temperature uniforming roller 126 is to be moved from the spacing position to the contact position (Y in S105), the controller 800 rotates the web motor 134 in the forward direction to shift the temperature uniforming roller 126 from the spacing position to the contact position. As a result, the temperature uniforming roller 126 contacts also to the web 128.

When the temperature uniforming roller 126 moves from the contact position shown in part (a) of FIG. 2 to the spacing position shown in part (b) of FIG. 2, the movement roller 127 also moves in the urging direction because the movement roller 127 is urged to the temperature uniforming roller 126 by the spring 167. Therefore, when the temperature uniforming roller 126 is in the spacing position, the cleaning web 128 is additionally drawn out of the supply roller 130 by the movement of the movement roller 127.

When the temperature uniforming roller 126 is moved to the contact position (as in S106) in this state, the movement roller 127 is pushed back to the predetermined position against the urging force of the spring 167 as shown in part (c) of FIG. 2. Here, the cleaning web 128 which has been drawn out when the temperature uniforming roller 126 is moved to the spacing position remains in the same state, and therefore, cleaning web 128 is loosened or slacked.

In order to remove the looseness or the slack of the cleaning web 128, the controller 800 carries out a tension recovery process (slack removing process) immediately after the movement of the temperature uniforming roller 126 from the spacing position to the contact position (S170). By the tension recovery process, the controller 800 winds the cleaning web 128 up until the contact surface of the cleaning web 128 to the temperature uniforming roller 126 becomes movable.

More specifically, as shown in part (b) of FIG. 8, when the tension recovery process is carried out (S170), the controller 800 rotates the web motor 134 in the back line direction (S171) to wind the cleaning web 128 up by the winding-up roller 129 by a predetermined amount (S175). When the cleaning web 128 is wound up by the predetermined amount (0.3 mm in this embodiment), the web motor 134 stops (S176) to complete the tension recovery process (S178). In order to wind up 0.3 mm of the web, approximately 3 seconds (operation time of the motor 134) is required. The value is determined through an experiment.

During the tension recovery process, the contact surface of the cleaning web 128 cannot be moved. Therefore, when the recording material passes through the fixing device during the tension recovery process, an additional cleaning process (S180 of FIG. 7) is carried out in which the controller 800 winds the cleaning web 128 following the completion of the tension recovery process (continuously with the web winding-up process for the removal of the looseness of the web).

In order to carry out the additional cleaning process, the controller 800 adds a distance correction value determining a winding-up amount Ltf of the cleaning web to be wound up by the additional cleaning process during the tension recovery process. More specifically, when the backward rotation of the web motor 134 starts in the tension recovery process (S171 of part (b) of FIG. 8), the controller 800 initializes the distance correction value Lf (S172), and discriminates whether or not the recording material P passes through the fixing device 141 (S173).

If the recording material P has passed the fixing device 141 (Y in S173), the distance correction value Lf is added in accordance with the length of the recording material P having passed. When the length of the recording material P exceeds 215.99 mm, "2" is added to the distance correction value, and if it is not more than 215.99 mm, "1" is added toward the distance correction value Lf.

Then, the controller 800 continues the counting of the distance correction value Lf until the winding of the cleaning web 178 is completed (from N of S175 to S174). When the tension recovery process is completed, the controller 800 executes the above-described additional cleaning process (S180 of FIG. 7).

More specifically, as shown in part (c) of FIG. 8, in the execution of the additional cleaning process (S180), the controller 800 sets the winding-up amount Ltf in the process following the tension recovery process, on the basis of the distance correction value Lf. That is, the winding-up amount is set to Ltf=(Lf/2)×0.016 (mm), and the web motor 134 is rotated backwardly through the amount corresponding to the winding-up amount Ltf (S181). When the web motor 134 is rotated backwardly through the amount corresponding to the winding-up amount Ltf, the web motor 134 is stopped (S182), and the additional cleaning process is completed (S183).

As described hereinbefore, when the temperature uniforming roller 126 is shifted from the spacing position to the contact position, that is, when it is shifted from the spaced state to the contact state, the cleaning web 128 is wound up, so that the tension state of the cleaning web can be recovered. During such a winding-up operation, the fixing device 141 is capable of operating, and therefore, the productivity of the fixing device 141 is not decreased by such an operation of the cleaning portion 160.

In said embodiment, the winding-up amount of the cleaning web 128 in the tension recovery operation is determined beforehand by experiments. However, the looseness of the cleaning web 128 can be detected, by, for example, detecting the position of the cleaning web 128, or detecting whether or not the drive sensed by a rotary encoder provided on the movement roller 127 is transmitted to the web roller. Therefore, the winding-up amount of the cleaning web 128 may be the amount required until the looseness detected by such a sensor is eliminated. In other words, the predetermined amount is such an amount that upon the switching from the spaced state to the contact state, the stretched state with which the contact surface of the cleaning web 128 to the temperature uniforming roller 126 becomes movable by the rotation of the winding-up roller 129.

By the following-up winding of the cleaning web 128 in accordance with the length of the recording material passing during the tension recovery winding-up operation, the deposited matter which may otherwise remain on the temperature uniforming roller 126 can be removed. By this, the damage to the pressing roller 118 by the deposited matter and the decrease of the uniform heating property of the temperature uniforming roller 126 can be prevented, and therefore, the cleaning portion 160 can keep a high cleaning performance without reduction of the productivity of the fixing device 141 (image heating portion 150). Particularly, the temperature uniforming roller 126 of which the surface temperature tends to lower because it is not always in contact with the pressing roller 118, involves the nature that the deposited toner thereon tends to solidify and therefore tends to become difficult to remove, but according to this embodiment, the cleaning portion 160 can remove such toner before solidification.

In this embodiment, the correction winding-up amounts are predetermined in accordance with the recording material sizes, and the predetermined value is added depending on the recording material P passed through the fixing device 141 during the winding-up operation. The amount to add is dependent on whether or not the length of the sheet is larger than 215.9 mm, that is, whether or not the sheet size is larger than A4 size, and therefore, the winding-up amount of the cleaning web 128 can be adjusted properly.

The power transmission mechanism 170 is capable of selectively transmitting the forward and backward rotations of the web motor 134 to the winding-up roller 129 and to the temperature uniformizing roller moving mechanism 154. By using a reversible web motor 134, the driving source may be common to the winding-up roller 129 and the temperature uniformizing roller moving mechanism 154, so that the fixing device 141 may be compact.

Second Embodiment

Figure 9:
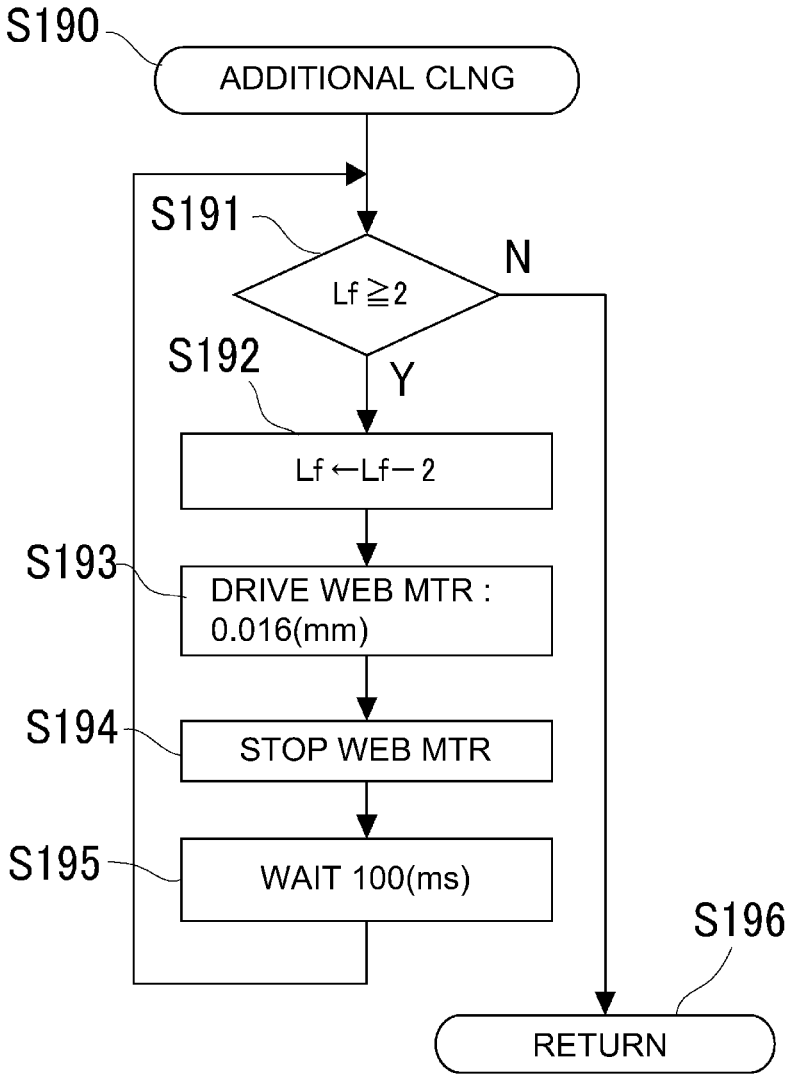
FIG. 9 is a flow chart showing the correction cleaning process.

Referring to FIG. 9, a fixing device according to a second embodiment of the present invention will be described. The fixing device of the second embodiment is different from the fixing device of the first embodiment only in the control method of the additional cleaning process. In the description of this embodiment, the same reference numerals as in Embodiment 1 are assigned to the elements having the corresponding functions in this embodiment, and the detailed description thereof is omitted for simplicity.

As shown in FIG. 9, at the start of the execution of the additional cleaning process (S190), a controller 800 discriminates whether or not a distance correction value Lf is not less than 2. If the distance correction value Lf is not less than 2 (Y of S191), the distance correction value Lf is subtracted by 2 (S192), and the web motor 134 is driven (S193).

When the cleaning web 128 is wound up by 0.016 mm, the controller 800 stops the web motor 134 (S194), and rests for a predetermined duration (S195). In this embodiment, the rest duration is 100 ms, which corresponds to one full rotation of the temperature uniforming roller 126 empirically determined.

The controller 800 repeats the operations of steps S191-S195 until the distance correction value Lf becomes less than 2. If the distance correction value Lf becomes less than 2 (N of S191), the additional cleaning process ends (S196).

In this manner, in this embodiment, when a plurality of recording materials pass through the fixing device 141 during the tension recovery process, the winding of Ltf and stopping are repeated by the additional cleaning process operation. By this, a relatively larger amount of the deposited matter can be removed the cleaning web 128, corresponding to the rest duration. When the cleaning web 128 is continuously wound up, the temperature uniforming roller 126 is cleaned with the moving cleaning web 128, and therefore, a cleanable area of the cleaning web at a position is smaller than that in the case when the cleaning is carried out with the cleaning web 128 not moving. The cleaning performance per unit length of the web can be enhanced by cleaning with the cleaning web 128 at rest and then feeding the cleaning web 128.

In the fixing device 141 of the first and second embodiments, the fixing roller 117 is employed as the heating member, and the pressing roller 118 is employed as the pressing member, but the heating member and the pressing member may be films. The heater 151 for heating the heating member is not limited to a lamp heater, but may be a heater of an induction heating, resistance heating, radiation heating or heat pipe type or the like.

In this embodiment, the recording material P passing through the fixing device 141 is detected by the fixing sheet discharge sensor 808, but it may be discriminated whether or not the recording material P passes by the timing of the recording material P passing the fixing device 141 on the basis of a drive sequence of the feeding process.

The addition to the distance value Lc or the distance correction value Lf may be made different depending on the number of the recording materials passing through the fixing device 141, the image density (weighted thereby), or the amount of the used toner (weighted thereby).

The driving source may be provided for each of the motion of the temperature uniforming roller 126 toward and away from and the winding of the winding-up roller 129. Furthermore, in the foregoing embodiments, the cleaning portion 160 cleans the temperature uniforming roller 126, but the present invention is applicable to the cleaning of the pressing member and/or the heating member.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 195674/2012 filed Sep. 6, 2012, which is hereby incorporated by reference.

What is claimed is:

1. A cleaning device comprising:

(i) a cleaning unit for cleaning a rotatable member, said cleaning unit including, (i-i) a web;

(i-ii) a first roller on which said web is wound, (i-iii) a second roller configured and positioned to wind said web up;

(i-iv) a driving mechanism configured to drive said second roller, (i-v) a third roller configured and positioned to urge said web to said rotatable member, (i-vi) an urging portion configured and positioned to urge said third roller toward said rotatable member, (i-vii) a supporting mechanism supporting said third roller, said supporting mechanism permitting movement of said third roller relative to said first roller and said second roller against an urging force of said urging portion;

(ii) a moving mechanism configured and positioned to cause a relative movement between said cleaning unit and said rotatable member, between a first position in which said web is spaced from said rotatable member and a second position in which said web contacts said rotatable member; and (iii) a controller configured to control an operation of said driving mechanism, wherein when said moving mechanism causes the relative movement from the first position to the second position, said controller operates said driving mechanism for a predetermined duration to substantially eliminate the slackness of said web resulting from the relative movement.

2. A cleaning device according to claim 1, wherein said urging portion includes a spring.

3. A fixing device for heat fixing a toner image on a sheet in a nip, said fixing device comprising:

(i) a rotatable member;

(ii) a cleaning unit configured and positioned to clean said rotatable member, said cleaning unit including, (ii-i) a web;

(ii-ii) a first roller on which said web is wound, (ii-iii) a second roller configured and positioned to wind said web up;

(ii-iv) a driving mechanism configured to drive said second roller, (ii-v) a third roller configured and positioned to urge said web to said rotatable member, (ii-vi) an urging portion configured and positioned to urge said third roller toward said rotatable member, (ii-vii) a supporting mechanism supporting said third roller, said supporting mechanism permitting movement of said third roller relative to said first roller and said second roller against an urging force of said urging portion;

(iii) a moving mechanism configured and positioned to cause a relative movement between said cleaning unit and said rotatable member, between a first position in which said web is spaced from said rotatable member and a second position in which said web contacts said rotatable member; and (iv) a controller configured to control an operation of said driving mechanism, wherein when said moving mechanism causes the relative movement from the first position to the second position, said controller operates said driving mechanism for a predetermined duration to substantially eliminate the slackness of said web resulting from the relative movement.

4. A fixing device according to claim 3, wherein when a fixing process is carried out concurrently the slackness eliminating operation, said controller controls said driving mechanism so as to wind up said web on said second roller additionally by an amount corresponding to a number of the sheets subjected to the fixing process during the slackness eliminating operation.

5. A fixing device according to claim 4, wherein in the additional winding up operation, said controller controls said driving mechanism so as to wind up said web intermittently.

6. A fixing device according to claim 3, wherein when said rotatable member is continuously in the contact position, said controller controls said driving mechanism so as to wind up a predetermined amount for each passages of a predetermined number of sheets through said nip.

7. A fixing device according to claim 3, wherein said urging portion includes a spring.

8. A fixing device according to claim 3, further comprising a second rotatable member and a third rotatable member which form the nip, wherein, when said cleaning unit and said rotatable member are in the second position, said rotatable member and said second rotatable member are in contact.

9. A fixing device comprising:

a first rotatable member and a second rotatable member configured and positioned to form a nip effective to heat fix a toner image on a sheet, (ii) a heat conduction rotatable member configured to contact said first rotatable member and conduct heat of said first rotatable member in a direction of an axis thereof;

(iii) a moving mechanism configured and positioned to move said heat conduction rotatable member relative to said first rotatable member between a contact position in which said heat conduction rotatable member contacts said first rotatable member and a spacing position in which said heat conduction rotatable member is spaced from said first rotatable member;

(iv) a cleaning unit configured and positioned to clean said heat conduction rotatable member, said cleaning unit comprising, (iv-i) a web;

(iv-ii) a first roller on which said web is wound, (iv-iii) a second roller configured and positioned to wind said web up;

(iv-iv) a driving mechanism configured to drive said second roller, (iv-v) a third roller configured and positioned to urge said web to said heat conduction rotatable member;

wherein said cleaning unit is disposed at such a position that with movement of said heat conduction rotatable member from the contact position to the spacing position, said heat conduction rotatable member moves from the contact position to the spacing position, and wherein said cleaning unit includes an urging portion configured and positioned to urge said third roller toward said heat conduction rotatable member, and a supporting mechanism supporting said third roller and permitting relative movement of said third roller relative to said first roller and said second roller against an urging force of said urging portion.

10. A fixing device according to claim 9, further comprising a controller configured to control an operation of said driving mechanism, wherein when said heat conduction rotatable member moves from the spacing position to the contact position, said controller controls said driving mechanism to wind up said web to eliminate slackness of said web resulting from the movement of said heat conduction rotatable member.

11. A fixing device according to claim 10, wherein when a fixing process is carried out concurrently the slackness eliminating operation, said controller controls said driving mechanism so as to wind up said web on said second roller additionally by an amount corresponding to a number of the sheets subjected to the fixing process during the slackness eliminating operation.

12. A fixing device according to claim 11, wherein in the additional winding up operation, said controller controls said driving mechanism so as to wind up said web intermittently.

13. A fixing device according to claim 10, wherein when said rotatable member is continuously in the contact position, said controller controls said driving mechanism so as to wind up a predetermined amount for each passages of a predetermined number of sheets through said nip.

14. A fixing device according to claim 9, wherein said urging portion includes a spring.

15. A cleaning device comprising:

(i) a cleaning unit for cleaning a rotatable member, said cleaning unit including, (i-i) a web contactable to said rotatable member at a contact surface, (i-ii) a first roller on which said web is wound, (i-iii) a second roller configured and positioned to wind said web up;

(i-iv) a driving mechanism configured to drive said second roller, (i-v) a contact member contacted to a surface of said web opposite the contact surface, (i-vi) a supporting mechanism supporting said contact member, said supporting mechanism being capable of permitting said contact member to move between a first position and a second position which is closer to said first roller and said second roller than the first position, (i-vii) an urging portion configured to urge said contact member in a direction from the second position to the first position, (ii) moving mechanism configured and positioned to cause a relative movement between said cleaning unit and said rotatable member so that said web takes a spaced position in which said web is in contact with said contact member placed in the first position and in which said web is spaced from said rotatable member or takes a nipped position in which said web is nipped between said rotatable member and said contact member placed in the second position (iii) a controller configured to control an operation of said driving mechanism, wherein when said moving mechanism causes the relative movement from the spaced position to the nipped position, said controller operates said driving mechanism for a predetermined duration to substantially eliminate the slackness of said web resulting from movement of said contact member from the first position to the second position.

16. A cleaning device according to claim 15, wherein said urging portion includes a spring.

* * * * *